United States Patent [19]

Creske

[11] 4,428,305

[45] Jan. 31, 1984

[54] TABLE TOP

[76] Inventor: Edward J. Creske, P.O. Box 1520, Wausau, Wis. 54401

[21] Appl. No.: 251,545

[22] Filed: Apr. 6, 1981

[51] Int. Cl.[3] ..... A47B 3/00

[52] U.S. Cl. ..... 108/150; 108/33; 108/159

[58] Field of Search ..... 220/212, 287, 306, 309, 220/324, 355, 1 H; 229/5.6; 108/150, 157, 159, 24, 33

[56] References Cited

U.S. PATENT DOCUMENTS

| | | | |
|---|---|---|---|
| 1,190,723 | 7/1916 | Caylor | 220/5.6 |
| 1,644,001 | 10/1927 | Telschow | 220/306 |
| 2,004,852 | 6/1935 | Coyle | 220/306 |
| 2,158,770 | 5/1939 | Bartlett | 220/1 H |
| 2,289,758 | 7/1942 | Conway, Jr. | 220/355 |
| 2,579,354 | 12/1951 | Zelt | 220/306 |
| 3,850,117 | 11/1974 | Martinelli | 108/150 |
| 4,078,502 | 3/1978 | Barna | 108/150 |
| 4,198,040 | 4/1980 | Colasent | 220/287 |

*Primary Examiner*—James T. McCall

*Attorney, Agent, or Firm*—John S. Roberts, Jr.

[57] ABSTRACT

A table top having the major part of its surface surrounding a central opening and including a plurality of radially disposed integrally formed locking means associated therewith for removably securing the same to a receptacle.

1 Claim, 5 Drawing Figures

TABLE TOP

BACKGROUND OF THE INVENTION

Generally, when people picnic they normally engage in a multi-step operation, the first step being the placing of the food on a picnic table, eating, and thereafter collecting the trash and depositing it in receptacles provided nearby. It has been suggested in Patents 3,593,669 and 3,683,824 to combine an eating surface with a receptacle whereby the picnic trash may be readily and conveniently disposed.

SUMMARY OF THE INVENTION

The present invention is directed to a table top which is fabricated from sheet metal, plastic, cardboard, or the like, and which includes means for readily attaching the same to a receptacle in a secure manner. The table top comprises a flat planar surface encompassing a central opening and includes a plurality of radially disposed locking tabs which can be pushed downwardly to engage the topmost part of the container to which it is to be connected. The locking tabs are provided at various radial distances whereby selected ones in common radial planes can be utilized to secure the same to any receptacle notwithstanding the dimensions thereof. Once secured, food can be placed on the planar surface and after picnicking the remains can be pushed into the opening which is disposed over the trash receptacle. The table is then removed and stored for further usage.

DESCRIPTION OF THE PREFERRED EMBODIMENT

Figure 1:
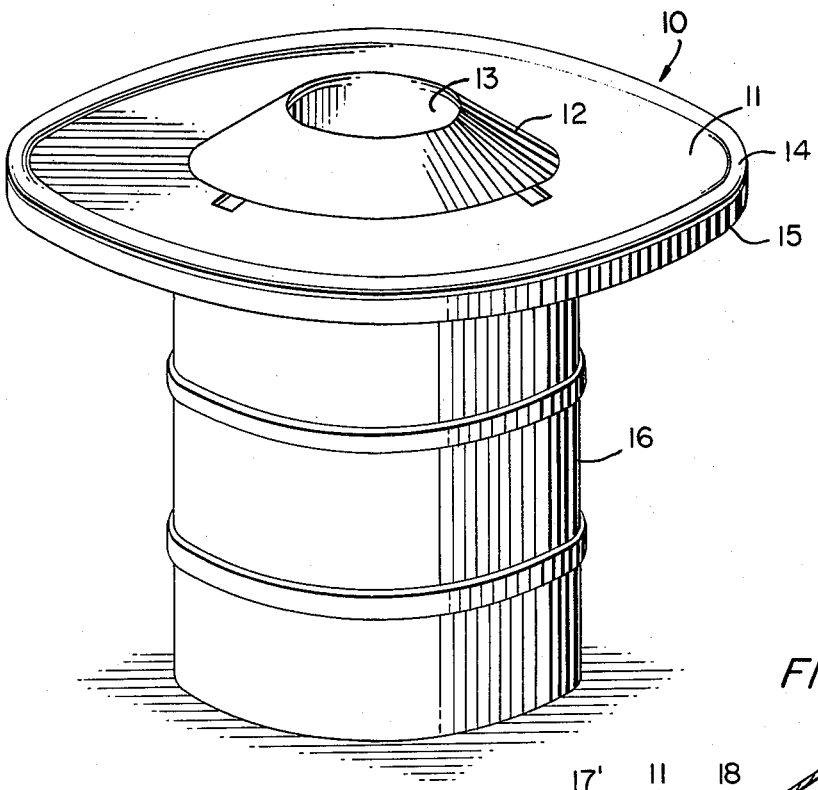
FIG. 1 is a perspective view of the table top in combination with a receptacle.
Figure 3:
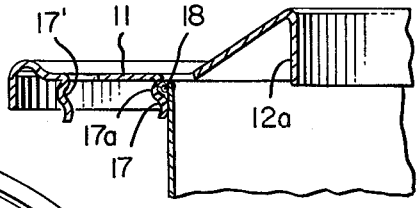
FIG. 3 is a sectional view taken on lines 3—3 of FIG. 2.
Figure 2:
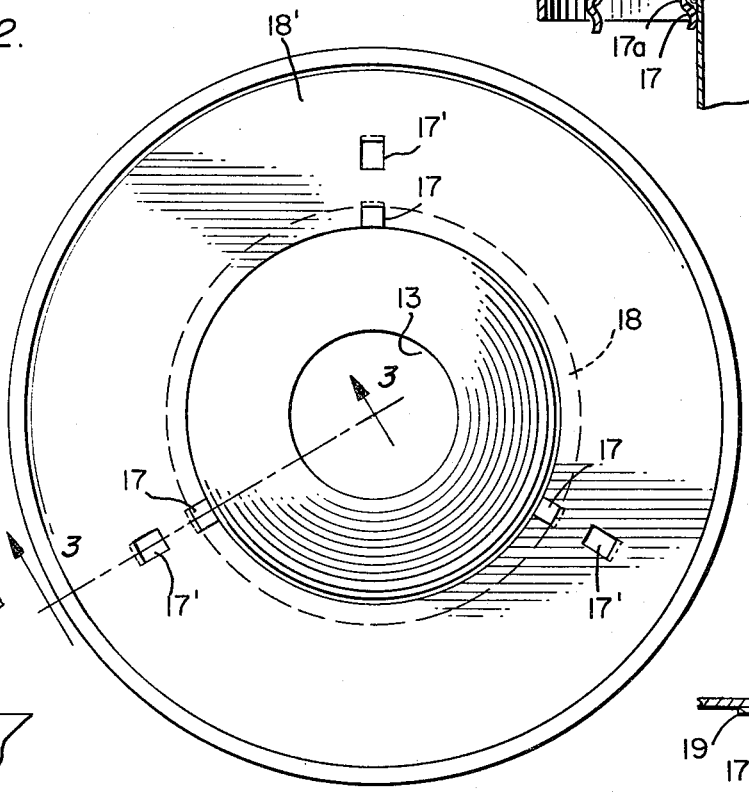
FIG. 2 is a top view of FIG. 1.

With reference to FIG. 1, the table top designated generally by the numeral 10 is seen associated with a receptacle 16 and comprises a flat planar surface 11 having an inner upwardly tapering cone section 12, having a downwardly extending annular wall 12*a*, see FIG. 3, forming a central opening 13. The outer peripheral edge 14 of the surface 11 is turned downwardly forming a flange 15 extending therearound.

Locking elements are integrally formed in the surface 11 and are comprised of a plurality of push down tabs 17, 17' disposed in common radial planes 18, 18' extending outwardly from the center point of the opening 13.

These tabs are formed by cutting three sides thereof which permits the same to be readily pushed downwardly for use. As is apparent, the provision of these radially disposed tabs permits the table top to be secured to any receptacle notwithstanding its dimensions.

Figure 4:
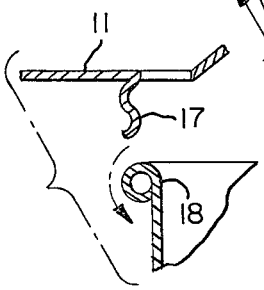
FIG. 4 is an assembly view showing the manner in which the table top engages the receptacle.

As seen in FIGS. 3 and 4, one of the tabs 17 is seen as being pushed downwardly and FIG. 4 depicts its alignment with the receptacle ring 18 prior to its engagement therewith, while FIG. 3 shows the completed assembly. The use of three locking tabs have been found sufficient to effect the engagement although two or more can be utilized. With continuing reference to FIG. 3, it is noted that the tab 17 is shaped with a curvilinear surface 17*a* which conforms to the shape of ring 18 and enhances its engagement therewith along with the inherent resiliency of the same.

Figure 5:
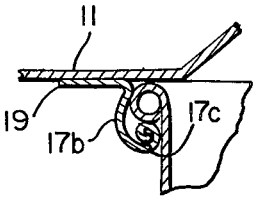
FIG. 5 is a sectional view of an alternative securing means.

Alternatively, the securing means 17 can take the shape 17*b* as shown in FIG. 5 wherein the same is in the form of an attachment which can be welded as at 19 or otherwise secured to the underside of the eating surface 11 to engage the receptacle ring 18. As seen, the means 17*b* terminates in a rolled section which resiliently engages the ring in a linear fashion to secure the same thereto. The securing means 17*b* are radially arranged in the manner as described above in conjunction with the integrally formed tabs 17.

In use, after the dimensions of the receptacle are noted, the tabs in the proper radial circular array are selected for locking the table thereto whereafter the picnic is conducted on the surface 11. After eating, the trash is pushed upwardly over the cone surface 12 into the opening 13 and receptacle 16. The top is washed, removed and stored for further use.

What I claim is:

1. A lightweight table top capable of holding dishes, glasses and the like thereon comprising a generally planar surface, an opening disposed centrally thereof, and at least one circularly disposed array of locking elements provided therewith for securing the same to an open top receptacle with the centrally disposed opening being aligned with said open top;

said locking elements being formed in said planar surface by cutting the same on three sides thereof whereby each can be forced downwardly into engagement with the support, with each locking element being configured to conform to the shape of a surface on said receptacle for securing the same thereto; and said planar surface having an upwardly tapering cone section positioned within the interior thereof with said section having a depending annularly vertically disposed collar forming said central opening, whereby waste can be easily conducted into said receptacle by pushing the same up the cone surface into said central opening into said receptacle.

* * * * *